US012137844B2

(12) United States Patent
Lynch

(10) Patent No.: US 12,137,844 B2
(45) Date of Patent: Nov. 12, 2024

(54) INSULATED ANTIBACTERIAL POUCH

(71) Applicant: Class Intimacy Acts, LLC, Stafford, TX (US)

(72) Inventor: Nancy Jeanette Lynch, Stafford, TX (US)

(73) Assignee: Class Intimacy Acts, LLC, Stafford, TX (US)

( * ) Notice: Subject to any disclaimer, the term of this patent is extended or adjusted under 35 U.S.C. 154(b) by 579 days.

(21) Appl. No.: 17/369,116

(22) Filed: Jul. 7, 2021

(65) Prior Publication Data

US 2023/0007923 A1 Jan. 12, 2023

(51) Int. Cl.

| | |
|---|---|
| ***A47K 10/02*** | (2006.01) |
| ***A45C 3/00*** | (2006.01) |
| ***A45C 11/00*** | (2006.01) |
| ***A45C 13/10*** | (2006.01) |
| ***A45C 13/30*** | (2006.01) |

(52) U.S. Cl.

CPC ..... *A47K 10/025* (2013.01); *A45C 3/001* (2013.01); *A45C 11/008* (2013.01); *A45C 13/103* (2013.01); *A45C 13/1046* (2013.01); *A45C 13/30* (2013.01)

(58) Field of Classification Search

CPC ..... A45C 11/008; A45C 13/103; A45C 13/1046; A45C 13/30

USPC ..... 383/42

See application file for complete search history.

(56) References Cited

U.S. PATENT DOCUMENTS 4,854,736 A * 8/1989 McVeigh ..... B65D 31/04 383/110
5,501,338 A * 3/1996 Preston ..... B65D 21/0213 294/149
10,974,871 B2 4/2021 Ackerman et al.
2003/0115837 A1* 6/2003 Zimmer ..... B65D 33/1691 53/399
2005/0114983 A1* 6/2005 Demay ..... A41D 19/01529 2/160
2008/0004560 A1* 1/2008 Miskie ..... A61F 5/449 604/327
2009/0114633 A1* 5/2009 Naylor ..... H05B 3/36 219/528

(Continued)

OTHER PUBLICATIONS

"Hot Tub Towel Warmer bag with Microwavable Heat Pad", https://prices.best/products/hot-tub-towel-warmer-bag-with-microwavable-heat-pad Apr. 27, 2021.

"Large insulated scout bag.", https://www.pinterest.com/pin/525865693991068604/ Apr. 27, 2021.

(Continued)

*Primary Examiner* — Peter N Helvey

(74) *Attorney, Agent, or Firm* — Perkins Coie LLP; Michael Glenn

(57) ABSTRACT

A pouch includes first and second multilayered sidewalls each having a first surface and a second surface, the first and second multilayered sidewalls being connected together to define an interior space of the pouch between the first and second multilayered sidewalls, and a mouth defining an opening into the interior space. The multilayered sidewalls have an inner surface that is configured to be in contact with one or more objects contained within the pouch. A portion of the multilayered sidewall comprises a compound insulating layer. A portion of the multilayered sidewalls that comprises the inner surface is formed from an antibacterial material. An outer wrapping is formed from a water resistant material.

9 Claims, 2 Drawing Sheets

(56) References Cited

U.S. PATENT DOCUMENTS

| | | | | |
|---|---|---|---|---|
| 2013/0213986 | A1* | 8/2013 | Couvelier | B65D 25/22 220/737 |
| 2014/0041284 | A1* | 2/2014 | Nugent | A01M 1/2094 43/132.1 |
| 2014/0166926 | A1* | 6/2014 | Lee | C04B 38/085 252/181.2 |
| 2015/0045763 | A1* | 2/2015 | Barone, Jr. | A61J 1/16 604/408 |
| 2017/0065089 | A1* | 3/2017 | Schubiger | E04H 15/44 |
| 2017/0146285 | A1* | 5/2017 | Calvert | F25D 23/10 |
| 2019/0178565 | A1* | 6/2019 | Horton | F25D 3/045 |
| 2019/0298017 | A1* | 10/2019 | Potts | A45C 13/02 |

OTHER PUBLICATIONS

"Microwavable Towel Warmer 10' ×10 ' 4pak", https://www.myspatender.com/store/p22/myspatender/towelwarmers. html Apr. 27, 2021.

"The Pajamas Warming Pouch", https://www.pinterest.com/pin/30821578671794241/ Apr. 27, 2021.

"The Pajamas Warming Pouch (Red)", https://www.hammacher.com/product/pajamas-warming-pouch-1 Apr. 27, 2021.

"Wool Insulated Natural Lunch bag", https://www.pinterest.com/pin/131519251587544830/ Apr. 27, 2021.

"Wool Insulated Organic Cotton Lunch Bag—Olive Trim", https://lifewithoutplastic.com/wool-insulated-organic-cotton-lunch-bag-olive-trim/ Apr. 27, 2021.

"Wool Insulated Organic Cotton Lunch Bag—Orange Trim", https://www.pinterest.com/pin/555420566526814092/ Apr. 27, 2021.

* cited by examiner

INSULATED ANTIBACTERIAL POUCH

FIELD

Various of the disclosed embodiments concern an insulated antibacterial pouch.

BACKGROUND

Bacterial Vaginosis (Gardnerella Vaginitis) is a common infection that is linked to an imbalance of "good" and "harmful," anaerobic bacteria in women, and can be carried by men. Bacterial Vaginosis increases risks of contracting STI's because it reduces vaginal acidity levels and lowers natural defenses. Traces of Bacterial Vaginosis in the vagina compromise vaginal flora and a common cause of Bacterial Vaginosis is sexual activity with a new partner. Bacterial Vaginosis can be prevented by thoroughly cleaning the vagina, for example with a towel, immediately after sexual or intimate encounters.

However, a towel or other such cleaning device can provide an environment that is favorable to the growth of bacteria.

SUMMARY

An insulated antibacterial pouch includes first and second multilayered sidewalls each having a first surface and a second surface. The first and second multilayered sidewalls are connected together to define an interior space of the pouch between the first and second multilayered sidewalls, and a mouth that defines an opening into the interior space. The multilayered sidewalls have an inner surface that is configured to be in contact with one or more objects, e.g. towels, contained within the pouch. A portion of the multilayered sidewall comprises a compound insulating layer that retains warmth. An outer wrapping is formed from a water resistant material. A portion of the multilayered sidewalls that comprises the inner surface is formed from a silver ion bacteria-killing interior layer.

As such, embodiments provide a convenient way of storing and retaining warmth of preheated towels to assist in the act of immediately cleansing genitalia. The insulated antibacterial pouch thus keeps cleaning towels warm while also helping to prevent Bacterial Vaginosis and other bacterial infections.

DETAILED DESCRIPTION

Figure 1:
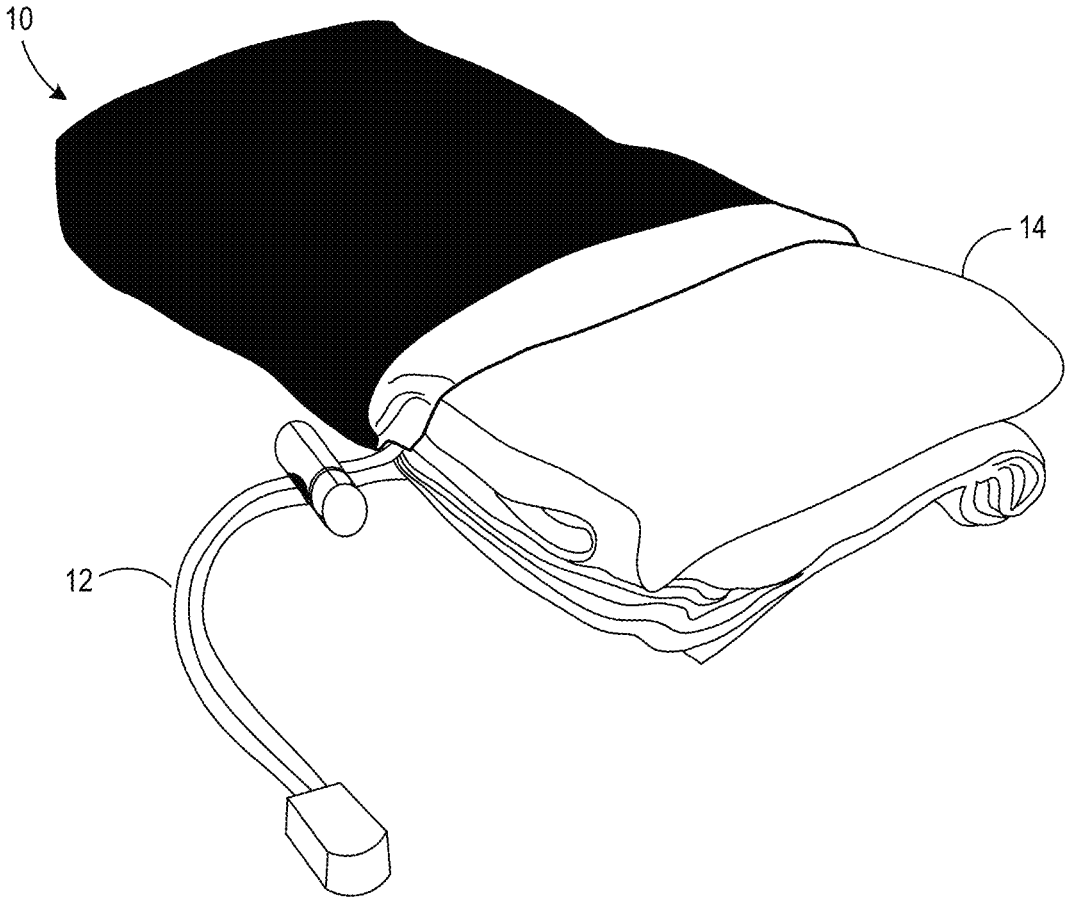
FIG. 1 is a perspective view of an insulated antibacterial pouch according to an embodiment of the invention.

Bacterial Vaginosis can be prevented by thoroughly cleaning the vagina immediately after sexual or intimate encounters. Such cleaning is readily effected with a preferably warm towel. However, such towel for example due to its warmth, both before and after use can provide a medium for the growth of bacteria such as that associated with Bacterial Vaginosis. Embodiments of the invention help prevent Bacterial Vaginosis by providing an insulated antibacterial pouch. In embodiments, the insulated antibacterial warming pouch is made of a mixture of wool and cotton batting, and covered in a polyester (polyurethane) water resistant material. Any exterior covering may be applied for desired design.

The insulated antibacterial pouch includes first and second multilayered sidewalls each having a first surface and a second surface. The first and second multilayered sidewalls are connected together to define an interior space of the pouch between the first and second multilayered sidewalls, and a mouth that defines an opening into the interior space. The multilayered sidewalls have an inner surface that is configured to be in contact with one or more objects, e.g. towels, contained within the pouch. A portion of the multilayered sidewall comprises a compound insulating layer that retains warmth. An outer wrapping is formed from a water resistant material. A portion of the multilayered sidewalls that comprises the inner surface is formed from a silver ion bacteria-killing interior layer. Thus, embodiments of the insulated antibacterial pouch keep heated towels warm while preventing the growth of bacteria on the towels.

Significantly, the insulated antibacterial pouch includes a silver ion bacteria-killing interior layer. As such, embodiments provide a convenient way of storing and retaining warmth of preheated towels to assist in the act of immediately cleansing genitalia. Silver interrupts the bacteria cell's ability to form the chemical bonds essential to its survival. These bonds produce the cell's physical structure. In 1893, the antibacterial effectiveness of various metals were noted and this property was named the oligodynamic effect. It was later found that out of all the metals with antimicrobial properties, silver has the most effective antibacterial action and the least toxicity to animal cells (Guggenbichler et al., 1999).

Silver fabric is helpful for producing antibacterial effects on clothing and fashion accessories. When the fabric is produced properly, the silver ions on the surface of a material treated with additives bind with microbes that come into contact with the surface and irreparably damage them, disrupting their normal cell function, which stops them from reproducing, and finally results in the death of the cell. Terminating the bacteria cell is beneficial in preventing Bacterial Vaginosis.

Silver nanoparticles have been used to impart antimicrobial activity to cotton fibers. Cotton samples were immersed in silver nanoparticle solutions and then subjected to a curing process to allow the nanoparticles to adhere to the cotton (El-Rafie et al., 2010). A chemical binder was then applied to the fabric to help maintain nanoparticle-cotton binding. Cotton samples prepared in this manner were able to reduce *S. aureus* and *E. coli* cell counts by 97% and 91% respectively. Even after subjecting the fabric to twenty laundry cycles, the cotton samples were still able to reduce *S. aureus* and *E. coli* cell counts by 94% and 85% respectively. Cotton prepared in this manner could be used by individuals working in the medical field or those who often work with microbes to prevent the spread of infectious bacteria (El-Rafie et al., 2010).

The insulated antibacterial pouch thus keeps cleaning towels warm while also helping to prevent Bacterial Vaginosis and other bacterial infections.

FIG. 1 is a perspective view of an insulated antibacterial pouch according to an embodiment of the invention. In FIG. 1, an insulated bacterial pouch 10 retains a towel 14 therein. The pouch may be closed to retain heat by a closure 12 which, in FIG. 1, is a pull string. However, any closure mechanism may be used to secure the pouch including, but not limited to, a zipper, hook and loop material, e.g. Velcro, snaps, and buttons. The dimensions of the pouch can vary in size (depending on towel size, design, and exterior covering).

In embodiments, a typical washcloth measures approximately 12"×12" or 13"×13." Knowing the size of the towel helps determine the dimensions—length, width, and mass of the pouch. Knowing the size of the folded towel helps the user pack it correctly in the pouch for best warmth outcome.

Damp-to-wet towel weight: A damp standard washcloth weighs approximately 700 g to 0.75 kg (1.5-1.6 lbs. 8 oz) Knowing the weight of the towel contributes to the dimensions of the pouch, and the materials needed to keep said towel warm.

Pouch dimensions: Length—7 inches×width—4.13 inches×height—1.75 inches.

The foregoing dimensions and weights are for purposes of example only. Those skilled in the art will appreciate that the herein disclosed pouch can be provided in any desired dimensions to accommodate towels and washcloths of all sizes.

Figure 2:
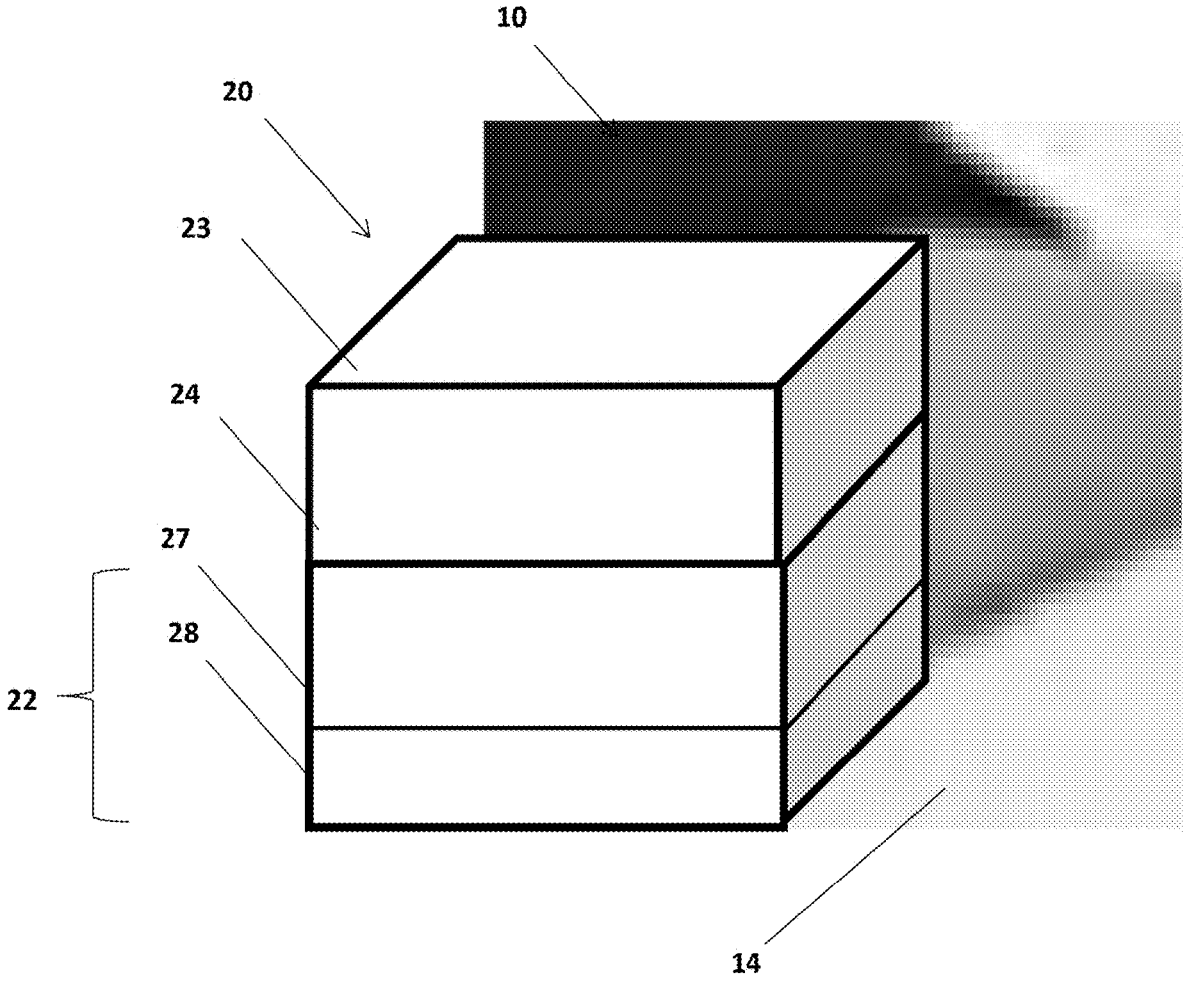
FIG. 2 is a cross section view of a portion of an insulated antibacterial pouch showing the structure thereof according to an embodiment of the invention.

FIG. 2 is a cross section view of a portion of an insulated antibacterial pouch showing the structure thereof according to an embodiment of the invention. In FIG. 2, the cross section 20 shows a multilayered interior portion 22 of the pouch 10 having a surface that is in contact with one or more towels 14 contained within the pouch. The interior portion of the insulated antibacterial pouch includes an insulating layer 27 that, in an embodiment, is made of a mixture of Smartwool (treated merino wool), cotton batting, and zeolite pellets (microporous, aluminosilicate minerals commonly used as adsorbents and catalysts). This layer generates and sustains heat. Those skilled in the art will appreciate that other insulating materials may be used. The pouch may be preheated, for example in a steam cabinet or microwave oven, or the pouch may be used to insulate preheated towels or washcloths, with or without the pouch being preheated. For example, in embodiments the zeolite pellets absorb and retain heat. For example, suppose that the pouch has been heated in a microwave oven before the warm towel is placed inside. The zeolite pellets inside of the internal structure hold onto the heat and release it upon the warm (damp) towel that has been placed inside, creating a warming effect. The zeolite pellets can store up to four times more heat than water for lengthy periods of time.

In embodiments, the inner layer 28 of the interior portion touching the towel is made of silver ion cotton, which is thought to kill 99% of bacteria and viruses within seconds of contact. The positively charged silver ion interferes with bacterial cell walls and disrupts other microbial processes. Researchers have observed that silver ions cause paired strands of DNA in bacteria to separate, and the binding between the protein and the DNA to weaken. Silver ions have a real-time response to killing bacteria which offers preventative measures, e.g. for Bacterial Vaginosis. Its antimicrobial technology offers continuous product protection against bacterial growth. Silver ions target microorganisms through various modes of action.

In embodiments, the outer wrapping 24 of the interior portion is made of polyester (polyurethane), a water resistant material. The outer wrapping, however, may be made of any other, preferably water resistant, material.

The outer wrapping exterior (outside of exterior for design) surface 23 provides a surface to which a desired design may be applied.

Additional features include a closure, such as a water resistant nylon zipper that closes the pouch to store heat therein. As noted above, any closure mechanism may be used to secure the pouch including, but not limited to, a draw string, hook and loop material, e.g. Velcro, snaps, and buttons.

Further, embodiments can include such features as a built in heater, carrying straps, temperature monitor, e.g. with a color indicator or other indicator (not too hot or too cold), used towel alert (monitors when towels are taken out and put back after use), etc.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

The invention claimed is:

1. A pouch, comprising:

first and second multilayered sidewalls each having a first surface and a second surface, the first and second multilayered sidewalls being connected together to define an interior space of the pouch between the first and second multilayered sidewalls, and to define a mouth that provides an opening into the interior space;

said first surface of said multilayered sidewalls comprising an inner surface that is configured to be in contact with one or more objects contained within the pouch;

a portion of said multilayered sidewall comprising a compound insulating layer, said compound insulating layer comprising a mixture of Smartwool (treated merino wool), cotton batting, and zeolite;

a portion of said multilayered sidewalls that comprises said inner surface formed from an antibacterial material, wherein said antibacterial material comprises a silver ion cotton material; and an outer wrapping, wherein said outer wrapping further is formed from a water resistant material.

2. The pouch of claim 1, said outer wrapping further comprising:

an outer surface defining an exterior portion of said pouch to which a design may be applied.

3. The pouch of claim 1, further comprising:

a closure at said mouth comprising any of a zipper, a draw string, hook and loop material, snaps, and buttons;

wherein the closure seals the mouth of the pouch to retain heat within the pouch.

4. The pouch of claim 1, further comprising:

a built in heater.

5. The pouch of claim 1, further comprising:

one or more carrying straps.

6. The pouch of claim 1, further comprising:

a temperature monitor.

7. The pouch of claim 1, wherein said one or more objects comprise one or more towels or washcloths;

said pouch further comprising:

a used towel alert.

8. An insulated antibacterial pouch, comprising:

first and second multilayered sidewalls each having a first surface and a second surface;

wherein said first and second multilayered sidewalls are connected together to define an interior space of the pouch between the first and second multilayered sidewalls, and to define a mouth that provides an opening into the interior space;

wherein said first surface of said multilayered sidewalls comprise an inner surface that is configured to be in contact with one or more objects contained within the pouch;

wherein a first layer of the multilayered sidewall comprises a compound insulating layer that retains warmth, said compound insulating layer composed of a mixture of treated merino wool, cotton batting, and zeolite;

wherein a second layer of the multilayered sidewall that comprises said inner surface is formed from a silver ion bacteria-killing material;

an outer wrapping formed from a water resistant material; and a closure at said mouth comprising any of a zipper, a draw string, hook and loop material, snaps, and buttons;

wherein the closure seals the mouth of the pouch to retain heat within the pouch.

9. The insulated antibacterial pouch of claim 8, wherein said silver ion bacteria-killing material kills bacteria that cause bacterial vaginosis.

* * * * *